US008837963B2

(12) United States Patent
Ohashi

(10) Patent No.: US 8,837,963 B2
(45) Date of Patent: Sep. 16, 2014

(54) IMAGE FORMING APPARATUS THAT FORMS COLOR IMAGES ON RECORDING SHEET BASED ON IMAGE INFORMATION

(75) Inventor: Yohei Ohashi, Kashiwa (JP)

(73) Assignee: Canon Kabushiki Kaisha (JP)

( * ) Notice: Subject to any disclaimer, the term of this patent is extended or adjusted under 35 U.S.C. 154(b) by 120 days.

(21) Appl. No.: 13/452,084

(22) Filed: Apr. 20, 2012

(65) Prior Publication Data

US 2012/0269530 A1 Oct. 25, 2012

(30) Foreign Application Priority Data

Apr. 22, 2011 (JP) ..... 2011-095912

(51) Int. Cl.
*G03G 15/00* (2006.01)
*G03G 15/01* (2006.01)
*G03G 15/16* (2006.01)

(52) U.S. Cl.
CPC .... *G03G 15/1615* (2013.01); *G03G 2215/0129* (2013.01); *G03G 15/5058* (2013.01); *G03G 15/0189* (2013.01); *G03G 15/161* (2013.01); *G03G 15/0131* (2013.01); *G03G 2215/0161* (2013.01); *G03G 15/5054* (2013.01); *G03G 2215/00143* (2013.01)
USPC ..... 399/49; 399/297; 399/301; 399/302

(58) Field of Classification Search
USPC ..... 399/49, 297, 301, 302
See application file for complete search history.

(56) References Cited

U.S. PATENT DOCUMENTS 6,141,522 A * 10/2000 Tsuruoka et al. ..... 399/302
2011/0097095 A1* 4/2011 Shirakata ..... 399/49

FOREIGN PATENT DOCUMENTS

JP 2000-034031 A 2/2000
JP 2004-069908 A 3/2004

* cited by examiner

*Primary Examiner* — Walter L Lindsay, Jr.
*Assistant Examiner* — Barnabas Fekete
(74) *Attorney, Agent, or Firm* — Rossi, Kimms & McDowell LLP

(57) ABSTRACT

An image forming apparatus having below arrangements. A plurality of image forming units form a plurality of images which are transferred onto a transfer belt. A detection unit detects a position of the transfer belt in a belt width direction. A position adjusting unit adjusts the position of the transfer belt in the belt width direction according to a detected position. A calibration unit calibrates an adjustment amount for adjusting color registration based on a detected position of patterns formed onto the transfer belt. A registration adjusting unit adjusts image forming positions of the plurality of image forming units based on the set adjustment amount. During formation of the patterns and during detection of the formed patterns a control unit controls not to adjust the position of the transfer belt in the belt width direction according to the detected position of the transfer belt.

4 Claims, 10 Drawing Sheets

IMAGE FORMING APPARATUS THAT FORMS COLOR IMAGES ON RECORDING SHEET BASED ON IMAGE INFORMATION

BACKGROUND OF THE INVENTION

1. Field of the Invention

The present invention relates to an image forming apparatus and a control method therefor, and particularly to an image forming apparatus that form color images on a recording sheet based on image information.

2. Description of the Related Art

Some electrophotographic color image forming apparatuses use a method that there are a plurality of image forming units, and images of different colors are successively transferred onto a transfer belt. For this type of image forming apparatuses, there is known a technique to correct for color registration. Specifically, the image forming apparatus forms color registration patterns on the transfer belt, reads the color registration patterns using a sensor, and calculates color registration error. Then, the image forming apparatus controls the times at which color images are formed based on the calculated registration error (Japanese Laid-Open Patent Publication (Kokai) No. 2004-69908).

Also, there is known techniques to control meandering of the transfer belt in a belt width direction. Specifically, the image forming apparatus detects the position of an edge of the transfer belt in the belt width direction using a sensor, and controls the tilt of one roller among steering rollers supporting the transfer belt so as to correct for meandering (Japanese Laid-Open Patent Publication (Kokai) No. 2000-34031). According to Japanese Laid-Open Patent Publication (Kokai) No. 2000-34031, in order to detect the position of the belt edge in the belt width direction, a sensor is placed at one position on one side of the belt in the belt width direction to continuously detect position variations of the transfer belt.

In the method that controls meandering of the transfer belt using the steering roller as described in Japanese Laid-Open Patent Publication (Kokai) No. 2000-34031, the transfer belt may become unstable due to meandering being uncontrollable at the activation of a roller driving motor or immediately after attachment or removal of a secondary transfer roller or a primary transfer roller. In a case where color images are formed when meandering occurs, image forming positions of colors do not match in a main scanning direction (the belt width direction of the transfer belt, that is, the direction in which the transfer belt meanders), and as a result, color-shifted images are formed.

Moreover, in a case where a color registration correction described in Japanese Laid-Open Patent Publication (Kokai) No. 2004-69908 is performed when the transfer belt meanders, color registration correction is performed based on detected color registration error caused by transitional meandering of the transfer belt. Under normal conditions, in order to reduce downtime, the color registration correction is not performed unless a predetermined number of prints have been made or a predetermined time period has elapsed. As a result, if color registration correction is performed based on an erroneous detection result mentioned above, color-shifted images are continuously output even for a short time period until the next color registration correction is performed.

SUMMARY OF THE INVENTION

The present invention provides an image forming apparatus having arrangements to be described below.

Accordingly, a first aspect of the present invention provides an image forming apparatus, comprising a plurality of image forming units a transfer belt onto which a plurality of images formed by the plurality of image forming units are transferred, a detection unit configured to detect a position of the transfer belt in a belt width direction, a position adjusting unit configured to adjust the position of the transfer belt in the belt width direction according to a detected position detected by the detection unit, a calibration unit configured to calibrate an adjustment amount for adjusting color registration based on a detected position of patterns formed onto the transfer belt by the image forming units, a registration adjusting unit configured to adjust image forming positions of the image forming units based on the calibrated adjustment amount, and a control unit configured to, during formation of the patterns and during detection of the formed patterns, control the position adjusting unit not to adjust the position of the transfer belt in the belt width direction according to the detected position of the transfer belt.

Further features of the present invention will become apparent from the following description of exemplary embodiments (with reference to the attached drawings).

DESCRIPTION OF THE EMBODIMENTS

The present invention will now be described in detail with reference to the drawings showing an embodiment thereof.

Figure 1:
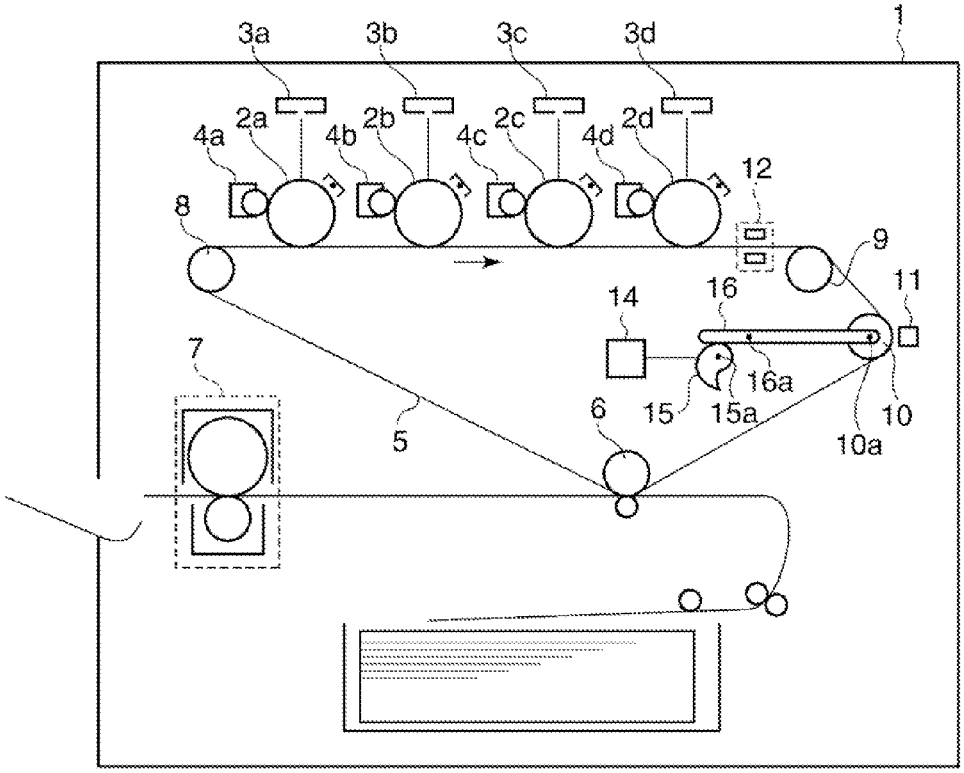
FIG. 1 is a view schematically showing an arrangement of an image forming apparatus according to an embodiment of the present invention.

FIG. 1 is a view schematically showing an arrangement of an image forming apparatus according to an embodiment of the present invention.

The image forming apparatus 1 is a color printer that has a plurality of image forming units and forms color images on a recording sheet based on image information.

The image forming apparatus 1 has photosensitive drums 2*a* to 2*d* which are image carriers, laser scanner units 3*a* to 3*d* which use a semiconductor laser is a light source, developing units 4*a* to 4*d*, and an endless transfer belt 5. Further, the image forming apparatus 1 has a secondary transfer roller 6, a thermal fixing unit 7, and a sensor (registration sensor) 11 which detects color shift detection patterns formed on the transfer belt 5.

In the image forming apparatus 1, electrostatic latent images are formed on the photosensitive drums 2*a* to 2*d* for respective colors by the respective laser scanner units 3*a* to 3*d*. The electrostatic latent images are developed by the developing units 4*a* to 4*d*. Then, toner images of the respective colors developed on the photosensitive drums 2*a* to 2*d* are primarily transferred onto the transfer belt 5. The toner images of the four colors on the transfer belt 5 are transferred onto a recording sheet by the secondary transfer roller 6, and fixed on the recording sheet by the thermal fixing unit 7 comprised of a fixing roller or the like.

BD sensors (not shown) are respectively provided on the laser scanner units 3*a* to 3*d*. The BD sensors detect the passage of laser light immediately before the laser light scans the photosensitive drums 2*a* to 2*d*, and generate BD signals which are one-line synchronization signals.

The transfer belt 5 is supported by a belt driving roller 8, a tension roller 9, a steering roller 10, and the secondary transfer roller 6, and is caused to rotate clockwise as viewed in the figure at a predetermined speed through rotation of the belt driving roller 8 driven by a motor, not shown. A belt skew restraint rib 13 (see FIG. 3) is provided on the circumference of a one-side edge (in the present embodiment, this is referred to the "back-side edge") of an underside of the transfer belt 5 so as prevent the transfer belt 5 from skewing to a predetermined position or father. The belt skew restraint rib 13 has a thickness not less than a thickness of the transfer belt 5.

Due to, for example, an error in alignment of a plurality of rotating members supporting an inner peripheral surface of the transfer belt 5, movement of the transfer belt 5 in a belt width direction according to rotation, that is, so-called belt skew occurs. If belt skew continues unaddressed, the transfer belt 5 will skew beyond a range that the rotating members support, and the transfer belt 5 will be broken or drop off. For this reason, as will be described later, belt skew is corrected for by controlling the tilt of the steering roller 10 (hereafter referred to as "steering control").

As control mechanisms to control the tilt of the steering roller 10, there are provided a belt edge sensor 12, a steering motor 14, a steering cam 15, and a steering arm 16. The belt edge sensor 12 is provided at such a position as to be in contact with an edge of the transfer belt 5, and detects the position of the transfer belt 5 in the belt width direction (a detecting unit). The steering arm 16 is placed so as to be able to rotate by a rotary shaft 16*a*, and has one end thereof supporting a rotary shaft 10*a* of the steering roller 10 and the other end thereof being in abutment with the steering cam 15. The steering cam 15 is cam-shaped as shown in the figure and placed so as to be able to rotate about a rotary shaft 15*a*. The steering motor 14 is a motor that rotatively drives the steering cam 15.

When the steering cam 15 is rotated clockwise as viewed from the front in FIG. 1, a right end of the steering arm 16 tilts downward as viewed in the figure, and on the other hand, when the steering cam 15 is rotated counterclockwise, the right end of the steering arm 16 tilts upward as viewed from the front in FIG. 1. By thus controlling the tilt of the steering roller 10 via the steering cam 15, the transfer belt 5 is moved to a target belt skew position.

Figure 2:
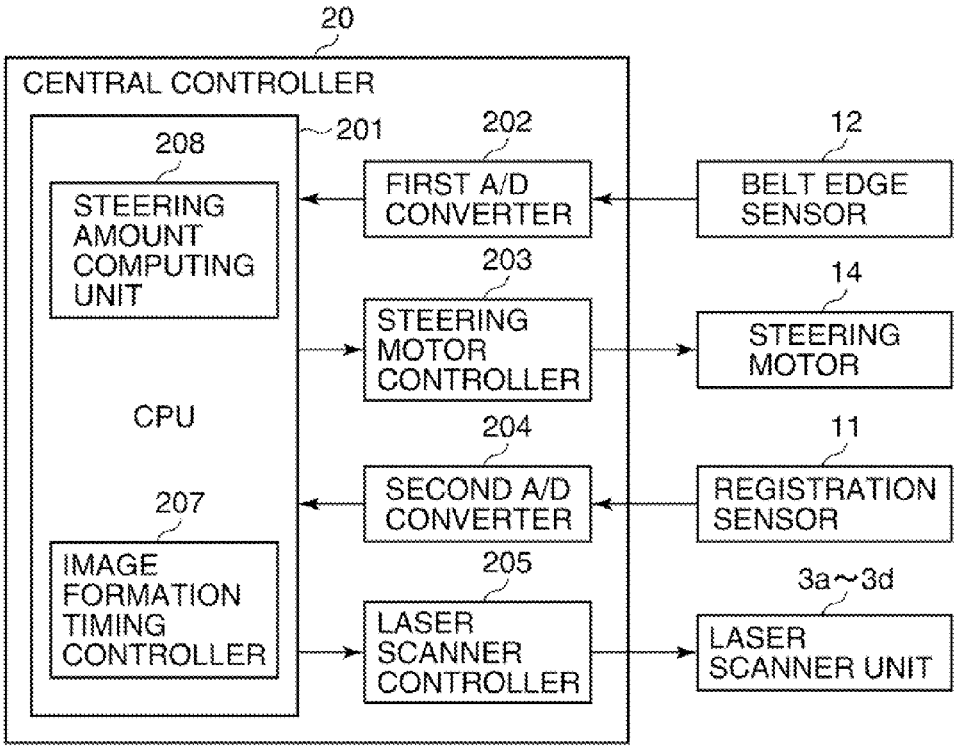
FIG. 2 is a block diagram schematically showing a functional unit associated with steering control and color registration correction in the image forming apparatus shown in FIG. 1.

FIG. 2 is a block diagram schematically showing a functional unit associated with steering control and color registration correction in the image forming apparatus 1 shown in FIG. 1.

Referring to FIG. 2, a central controller 20 is comprised of a CPU 201, a first A/D converter 202, a steering motor controller 203, a second A/D converter 204, and a laser scanner controller 205. The CPU 201 has a steering amount computing unit 208 and an image formation timing controller 207, and controls the operation of the image forming apparatus 1.

The image formation timing controller 207 generates main scanning synchronization signals based on BD signals output from the BD sensors, not shown, and controls the main-scanning write timing of the laser scanner units 3*a* to 3*d* (calibration unit). The image formation timing controller 207 also calculates the color registration error of the respective subject colors with respect to a reference color based on read values from the registration sensor 11, and further calculates correction amounts for the image formation timing of the respective subject colors.

Based on the color registration correction amounts calculated by the image formation timing controller 207 and the BD signals generated by the BD sensors, the laser scanner controller 205 corrects the write timing of the laser scanner units 3*a* to 3*d*. As a result, image forming positions of the respective colors are corrected (registration adjusting unit).

While the transfer belt 5 is being driven, the steering amount computing unit 208 computes the belt skew position of the transfer belt 5 in the belt width direction and the amount by which the steering roller 10 is controlled based on a sensor output from the belt edge sensor 12.

The steering motor controller 203 rotates the steering motor 12 based on the control amount of the steering roller 10 computed by the steering amount computing unit 208. Then, the steering cam 15 is controlled to a predetermined angle by the rotation of the steering motor 14.

Next, a description will be given of steering control in the image forming apparatus 1 described above.

Figure 3:
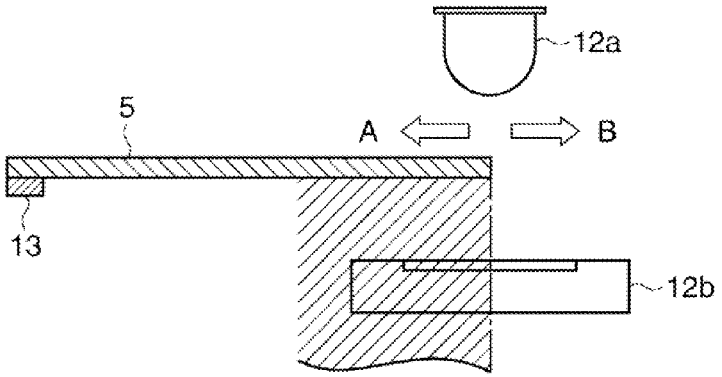
FIG. 3 is a view useful in explaining how the position of a transfer belt in a belt width direction is detected using a belt edge sensor.

FIG. 3 is a view useful in explaining how the position of the transfer belt 5 in the belt width direction is detected using the belt edge sensor 12.

The belt edge sensor 12 has a light-emitting unit 12*a* and a light-receiving unit 12*b*, which are placed so as to face each other across an edge of the transfer belt 5 as shown in the figure. When the transfer belt 5 is skewed in a direction A in the figure, the amount of light incident on the light-receiving unit 12*b* increases, which results in an increase in sensor output. On the other hand, when the transfer belt 5 is skewed in a direction B in the figure, the amount of light incident on the light-receiving unit 12*b* decreases, which results in a decrease in sensor output.

Therefore, to detect the position of the transfer belt 5 in the belt width direction, a sensor output corresponding a targeted belt skew position is stored in advance as a reference value. And when sensor output becomes greater than the reference value, it is determined that the transfer belt 5 is skewed in the direction A. On the other hand, when sensor output becomes smaller than the reference value, it is determined that the transfer belt 5 is skewed in the direction B.

The steering amount computing unit 208 computes the belt skew position of the transfer belt 5 in the belt width direction and the amount by which the steering roller 10 is controlled based on a sensor output from the belt edge sensor 12, and outputs the computation results to the steering motor controller 203.

Figure 4:
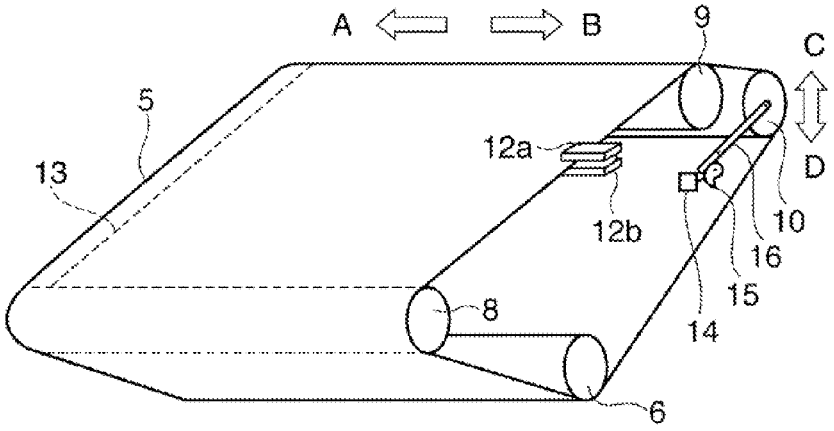
FIG. 4 is a perspective view showing portions of the image forming apparatus which are associated with steering control.
Figure 5:
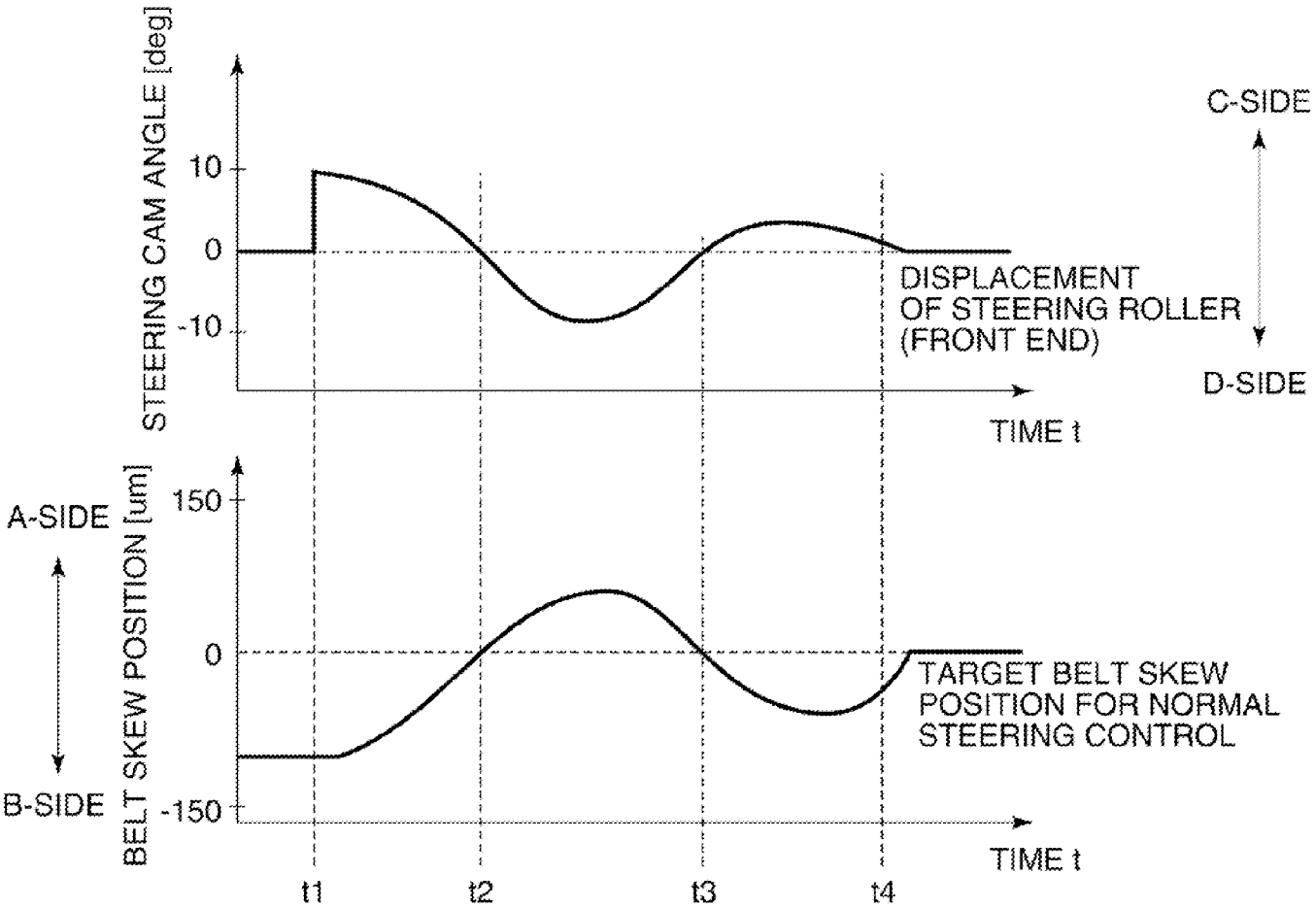
FIG. 5 is a diagram schematically showing the relationship between belt skew positions of the transfer belt and displacements of a steering roller.

FIG. 4 is a perspective view showing portions of the image forming apparatus 1 which are associated with steering control. FIG. 5 is a diagram schematically showing the relationship between belt skew positions of the transfer belt 5 and displacements of the steering roller 10.

For example, upon determining that the transfer belt 5 is skewed in a direction B in FIG. 4 based on an output from the steering amount computing unit 208, the steering motor controller 203 performs control to tilt a front side of the steering roller 10 in a direction C in FIG. 4. As a result, a greater tension is applied to a direction-B side of the transfer belt 5 than to a direction-A side of the transfer belt 5 as viewed in FIG. 4, and therefore, the transfer belt 5 is skewed in a direction A in FIG. 4. The relationship between the displacement of the steering roller 10 and the belt skew position at this time is as shown from t1 to t2 or from t3 to t4 in FIG. 5.

The steering amount computing unit 208 rotates the steering cam 15 by 10 degrees (counterclockwise as viewed from the direction B to the direction A in FIG. 4) per belt skew of 100 μm (in the direction from A to B in FIG. 4). In this way, control is performed to determine the amount of displacement of the steering roller 10 according to a shift of the belt skew position from a target belt skew position.

On the other hand, upon determining that the transfer belt 5 is skewed in the direction A in FIG. 4, the steering motor controller 203 tilts the steering roller 10 in a direction D in FIG. 4 to shift the transfer belt 5 in the direction B. The relationship between the displacement of the steering roller 10 and the belt skew position at this time is as shown from t2 to t3 in FIG. 5.

As described above, during steering control in the image forming apparatus 1, the transfer belt 5 is controlled to move to a target position.

A target belt skew position for normal image formation is set at a center position (FIG. 6A) so that the transfer belt 5 can stably lie within a range that the rotating members (rollers) support. Steering control is performed so as to consistently maintain the belt skew position at the set position (this control state will hereafter be referred to as "normal steering control"). In normal steering control, the position of the transfer belt 5 in the belt width direction is detected using the belt edge sensor 12, and based on the detection result, skew in the belt width direction is controlled.

On the other hand, a target belt skew position for color registration correction is as described hereafter. Specifically, the target belt skew position is set at a belt skew position (FIG. 6B) when the belt skew restraint rib 13 provided in the form of a strip at the one-side edge of the underside of the transfer belt 5 comes into contact with respective back ends of the belt driving roller 8, the tension roller 9, and the secondary transfer roller 6. In this state, the tilt of the steering roller 10 is fixed, and the belt skew position is restrained to a fixed position by the belt skew restraint rib 13 (this control state will hereafter be referred to as "rib restraint").

Figure 7:
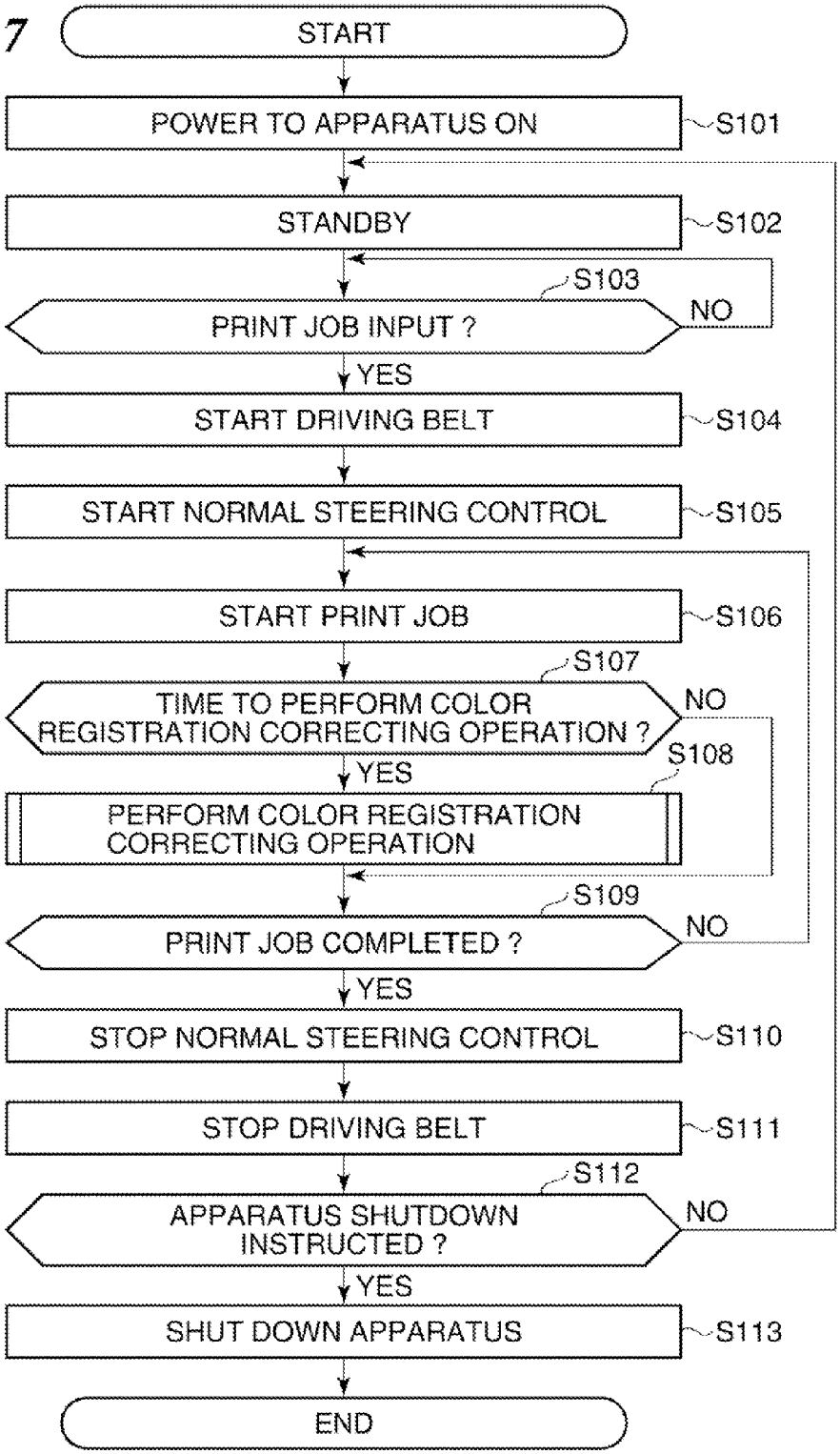
FIG. 7 is a flowchart showing the flow of normal steering control at the time of normal image formation in the image forming apparatus.
Figure 8:
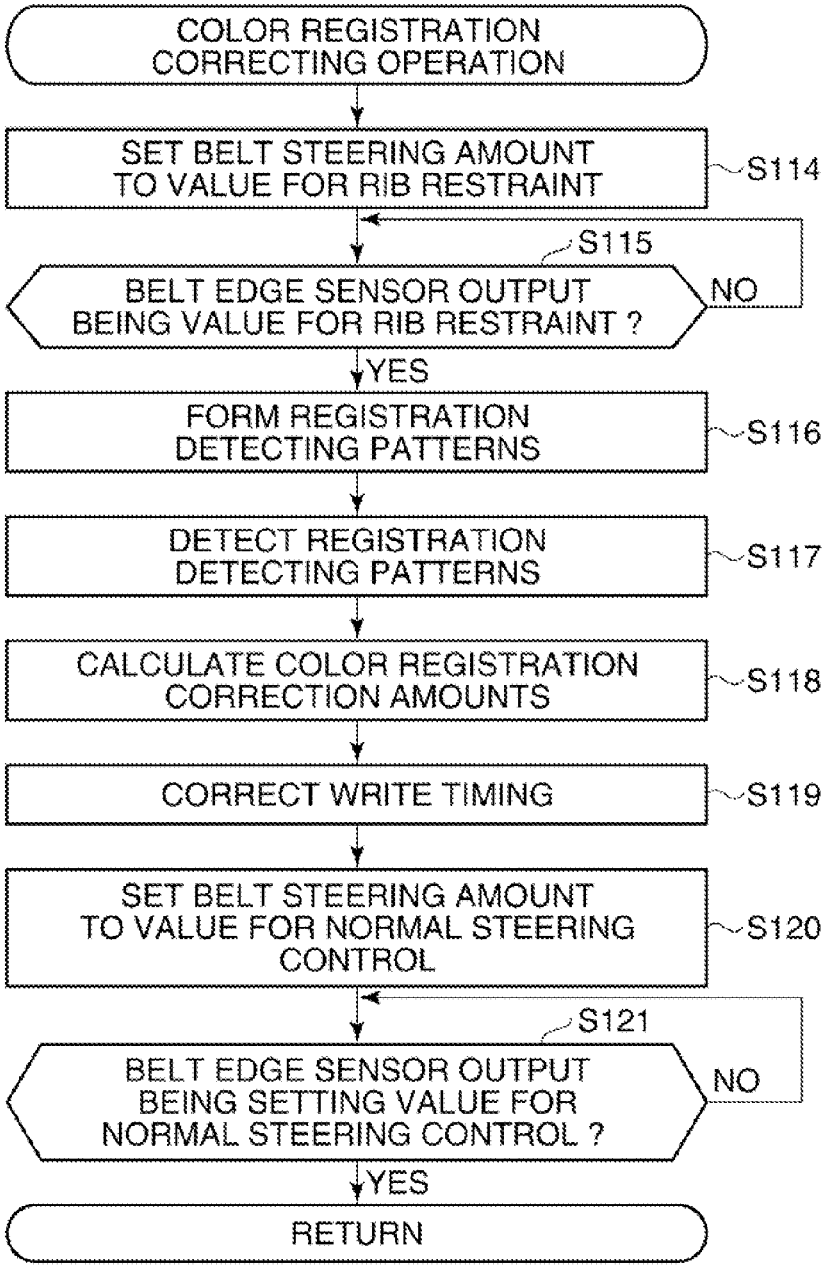
FIG. 8 is a flowchart showing the flow of rib restraint at the time of color shift correction in step S108 in FIG. 7.

Referring next to FIGS. 7 and 8, a description will be given of the flow of switching between normal steering control at the time of normal image formation and rib restraint at the time of color shift correction. It should be noted that in the present embodiment, color registration in the main scanning direction is corrected for.

FIG. 7 is a flowchart showing the flow of the normal steering control at the time of normal image formation in the image forming apparatus 1. FIG. 8 is a flowchart showing the flow of rib restraint at the time of color shift correction in step S108 in FIG. 7. It should be noted that these processes are carried out by the CPU 201 executing control programs read out from a memory, not shown, unless otherwise specified.

Figure 6B:
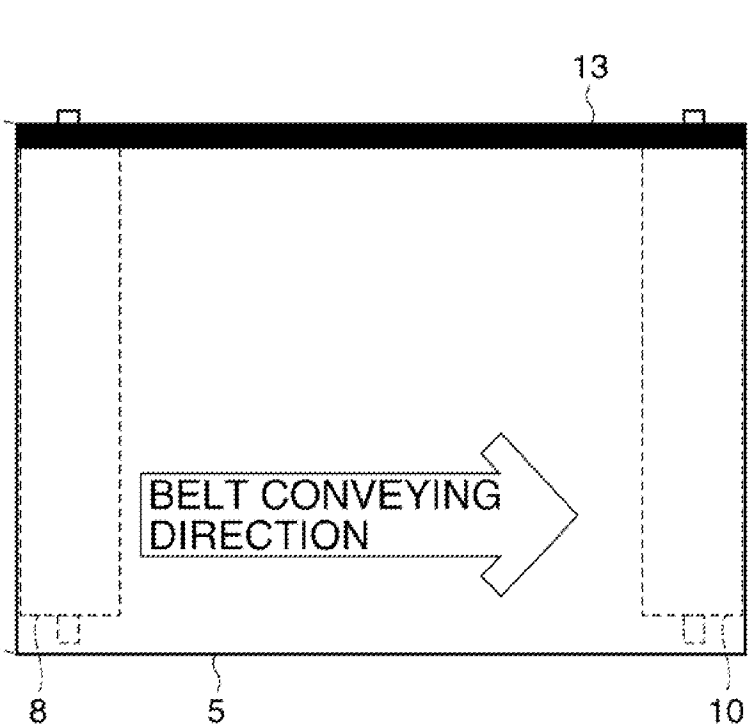
FIG. 6B is a view showing a belt skew position at the time of rib restraint.
Figure 6A:
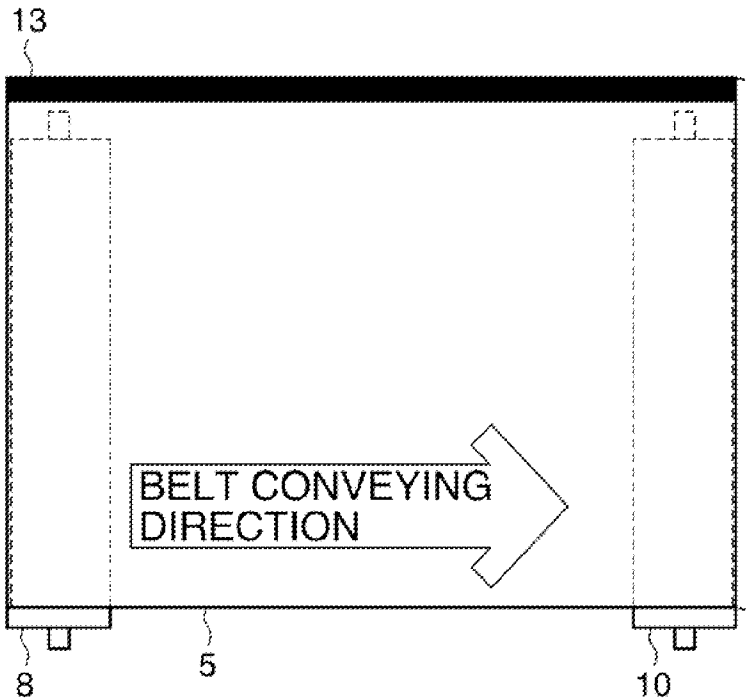
FIG. 6A is a view showing a belt skew position at the time of normal steering control.
Figure 9:
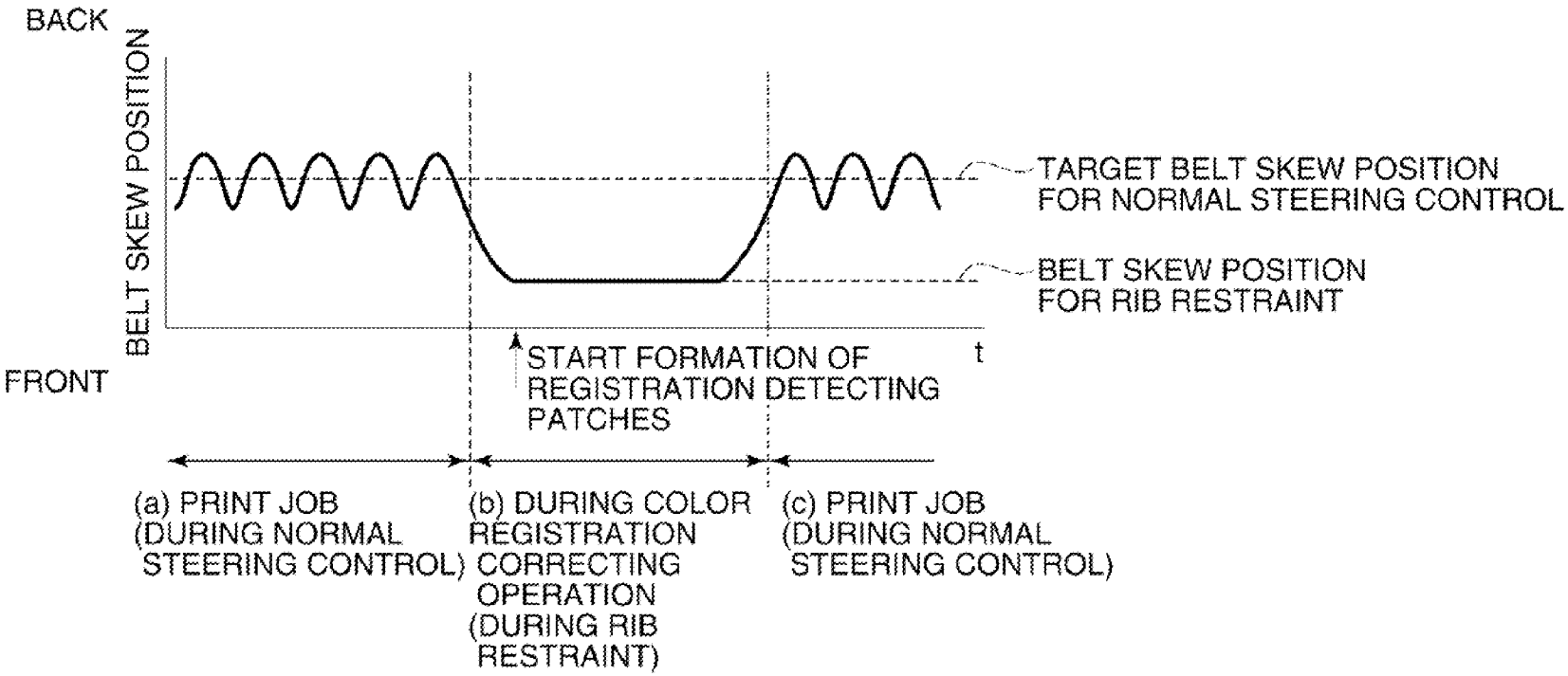
FIG. 9 is a diagram showing variations in belt skew position at the time of normal steering control and at the time of rib restraint.

Referring to FIG. 7, after the power is turned on (step S101), the image forming apparatus 1 is brought into a standby state (step S102) and then brought into a state of waiting for input of a print job (step S103). When a print job is input (YES in the step S103), driving of the transfer belt 5 (step S104) and normal steering control (step S105) are started, and then a printing operation appropriate to the print job is started (step S106). At this time, the steering motor controller 203 performs steering control based on a sensor output from the belt edge sensor 12 so that the transfer belt 5 can be maintained at a predetermined belt skew position as shown in FIG. 6A. The sensor output from the belt edge sensor 12 on this occasion is as shown in a section (a) in a graph of FIG. 9, and the belt skew position changes like an alternating current about the target belt skew position at the time of normal steering control.

Next, when the printing operation is being performed, the CPU 201 determines whether or not it is the time to perform a color registration correcting operation (step S107). Here, the amount for color registration correction is calibrated in the color registration correction operation.

When it is determined that it is not the time to perform a color registration correcting operation, the process proceeds to step S109, in which normal steering control is continued until the print job has been completed. Here, the time to perform the color registration correcting operation means the time at which the number of prints made by the apparatus reaches a predetermined value or the continuous print time reaches a predetermined time period, and can be arbitrarily set in advance.

When it is determined that it is the time to perform the color registration correcting operation, the color registration correcting operation is performed in the image forming apparatus 1 (step S108).

Referring to FIG. 8, the steering amount computing unit 208 sets the belt steering amount to a value for rib restraint (step S114). As a result, the belt skew restraint rib 13 is set at such a position as to be in abutment with the belt driving roller 8, the tension roller 9, and the secondary transfer roller 6, that is, a position for rib restraint (=a target belt skew position for color shift correction).

Figure 10:
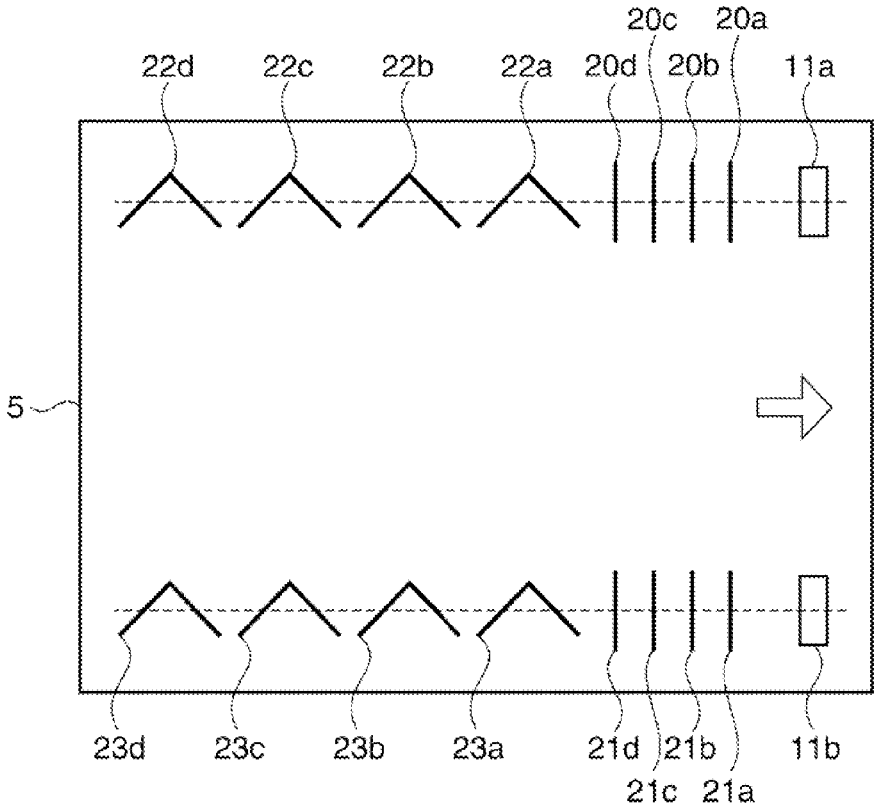
FIG. 10 is a view showing exemplary color shift detection patterns formed on the transfer belt.

Then, based on a sensor output from the belt edge sensor 12, the steering motor controller 203 determines whether or not the transfer belt 5 has reached the position for rib restraint (step S115). Upon determining that the transfer belt 5 has reached the position for rib restraint, the steering motor controller 203 fixes the tilt of the steering roller 10 to maintain the state in which the transfer belt 5 is restrained by the belt skew restraint rib 13 as shown in FIG. 6B. The sensor output from the belt edge sensor 12 on this occasion is as shown in a section (b) in the graph of FIG. 9, and the belt skew position is maintained at the position for rib restraint. In this state, predetermined color registration detecting patterns (registration detecting patterns) are formed on the transfer belt 5 in the image forming apparatus 1 (step S116). FIG. 10 is a view showing exemplary color registration detection patterns formed on the transfer belt 5.

In FIG. 10, patterns 20*a* to 20*d* and 21*a* to 21*d* are patterns for detecting color registration error values in a sheet conveying direction (indicated by an arrow in the figure). Patterns 22*a* to 22*d* and 23*a* to 23*d* are patterns for detecting color registration error values in the main scanning direction perpendicular to the sheet conveying direction.

Referring again to FIG. 8, the pair of registration sensors 11 provided on both sides on the transfer belt 5 start reading the color registration detecting patterns shown in FIG. 10 (step S117), and the amounts of color registration error between the colors which are differences from a reference color determined in advance are detected.

Next, the image formation timing controller 207 calculates color registration correction amounts for the respective colors except the reference color based on the detected amounts of color registration error. (step S118). Then, based on the color registration correction amounts calculated by the image formation timing controller 207 and BD signals, the laser scanner controller 205 corrects the write timing of the laser scanner units 3*a* to 3*d* (step S119). Namely, the image forming positions of respective colors are adjusted.

Then, the belt steering amount is set to a value for normal steering control (step S120), and when it is determined based on an output from the belt edge sensor 12 that the belt skew position has returned to a value for normal steering control (YES in step S121), the color shift correcting operation is brought to an end, and the process returns.

In the step S109 in FIG. 7, it is determined whether or not the print job has been completed (step S109), and when the print job has not been completed, the process returns to the step S106, in which the print job is resumed.

On the other hand, it is determined in the step S109 that the print job has been completed, the CPU 201 stops normal steering control (step S110) and belt driving (step S111), and further determines whether or not apparatus shutdown has been instructed (step S112). When apparatus shutdown has not been instructed, the apparatus returns to the standby state (step S102), and the CPU 201 brings the apparatus into a state of waiting for input of a print job. On the other hand, when apparatus shutdown has been instructed, the CPU 201 carries out a process to shut down the apparatus (step S113), and terminates the process.

As described above, by restraining belt skew using the belt skew restraint rib 13 at the time of color registration correction, the detection error in the color registration error due to the belt meandering can be reduced. Accordingly, an accuracy of the color registration correction can be maintained.

Moreover, at the time of normal image formation, normal steering control using the steering roller 10 is preformed, and at the time of color shift correction, control is switched to belt skew restraint using the belt skew restraint rib 13. As a result, a reduction in the longevity of the transfer belt 5 caused by long-time abutment of the belt skew restraint rib 13 on a back end of the belt driving roller 8 or the like can be prevented.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-095912 filed Apr. 22, 2011, which is hereby incorporated by reference herein in its entirety.

What is claimed is:

1. An image forming apparatus that forms an image based on input image data, comprising:

a plurality of image forming units;

a transfer belt onto which a plurality of images formed by said plurality of image forming units are transferred;

a detection unit configured to detect a position of said transfer belt in a belt width direction;

a steering roller configured to support said transfer belt;

a position adjusting unit configured to adjust a tilt of said steering roller according to the detected position of said transfer belt so as to adjust the position of said transfer belt in the belt width direction according to a detected position detected by said detection unit;

a calibration unit configured to calibrate an adjustment amount for adjusting color registration based on a detected position of patterns formed onto said transfer belt by said image forming units;

a registration adjusting unit configured to adjust image forming positions of said image forming units based on the calibrated adjustment amount; and a control unit configured to control said steering roller so that, in a case where said calibration unit calibrates the adjustment amount, the tilt of said steering roller is fixed after the position of said transfer belt in the belt width direction is adjusted to a first position, and in a case where said image forming units form an image based on the input image data, the tilt of said steering roller is adjusted according to the detected position of said transfer belt such that the position of said transfer belt in the belt width direction is in a second position.

2. An image forming apparatus according to claim 1, further comprising a driving roller configured to drive said transfer belt, wherein a rib is provided on an edge of one side in the belt width direction on an underside of said transfer belt, and the predetermined position is a position in which the rib reaches the edge of the driving roller.

3. An image forming apparatus according to claim 1, wherein said plurality of image forming units respectively has a laser unit and a photosensitive drum, and wherein said registration adjusting unit adjusts a time at which the laser unit starts to emit a laser in a main scanning direction.

4. An image forming apparatus according to claim 1, wherein said detection unit detects a position of an edge of one side in the belt width direction of said transfer belt.

* * * * *